US007108499B2

(12) United States Patent
Stefani

(10) Patent No.: US 7,108,499 B2
(45) Date of Patent: Sep. 19, 2006

(54) APPARATUS FOR REGULATING COMPONENTS OF ROTARY MACHINES FOR DECORATION OF CERAMIC TILES

(75) Inventor: Franco Stefani, Sassuolo (IT)

(73) Assignee: SYFAL S.p.A., Modena (IT)

( * ) Notice: Subject to any disclaimer, the term of this patent is extended or adjusted under 35 U.S.C. 154(b) by 347 days.

(21) Appl. No.: 10/653,351

(22) Filed: Aug. 28, 2003

(65) Prior Publication Data

US 2004/0081718 A1 Apr. 29, 2004

(30) Foreign Application Priority Data

Sep. 27, 2002 (IT) ..... MO2002A0271

(51) Int. Cl.
*B05C 1/02* (2006.01)

(52) U.S. Cl. ..... 425/194; 425/385; 118/244; 118/261

(58) Field of Classification Search ..... 425/194, 425/385; 118/244, 261
See application file for complete search history.

(56) References Cited

U.S. PATENT DOCUMENTS 3,693,585 A * 9/1972 Reeve et al. ..... 118/104
4,309,945 A 1/1982 Marion
5,378,503 A * 1/1995 Kohler et al. ..... 427/356
5,477,781 A * 12/1995 Stefani ..... 101/153
5,743,964 A * 4/1998 Pankake ..... 118/712

FOREIGN PATENT DOCUMENTS

| | | |
|---|---|---|
| EP | 0 677 364 | 10/1995 |
| GB | 2 207 092 | 1/1989 |
| NL | 9201144 | 1/1994 |

* cited by examiner

*Primary Examiner*—Joseph S. Del Sole
*Assistant Examiner*—Maria Veronica Ewald
(74) *Attorney, Agent, or Firm*—Young & Thompson

(57) ABSTRACT

On a mobile rest plane on which tiles are translated in a predetermined direction, the following operate: a matrix-bearing cylinder, mobile in rotation about an axis thereof, and at least a doctor predisposed to operate contactingly with an external surface of the cylinder. The apparatus comprises: a vertically-developing frame; a first slide constrained on the vertical frame and slidable vertically with respect thereto; the matrix-bearing cylinder being supported on the first slide, together with organs for supporting the matrix-bearing cylinder and organs for controlling rotation thereof about a rotation axis thereof; a second slide, with at least one doctor being supported thereon, together with organs for supporting the doctor and organs for controlling movements thereof, is constrained on the frame and can slide vertically with respect thereto. An electrically-activated maneuvering screw produces relative positioning of the first slide and the second slide and positioning of the slides with respect to the vertically-developing frame.

17 Claims, 3 Drawing Sheets

APPARATUS FOR REGULATING COMPONENTS OF ROTARY MACHINES FOR DECORATION OF CERAMIC TILES

BACKGROUND OF THE INVENTION

Specifically, though not exclusively, the invention is usefully applied in rotary machines of the type in which a matrix-bearing cylinder, mobile in rotation about an axis thereof, operates on a mobile rest plane on which tiles are translated in a predetermined direction, with at least one doctor predisposed to operate in contact with the external surface of the cylinder.

In the present example the matrix-bearing cylinder is provided with at least one elastically-deformable peripheral part limited by a smooth external cylindrical surface made of an elastomer material on which a shape is recessed, constituting the matrix.

In known machines of this type the doctor is in a fixed position with respect to the cylinder, while the doctor-cylinder group is mobile and adjustable with respect to the mobile rest plane of the tiles.

This constitutes a big limitation because each prior-art rotary machine is by its nature only able to use matrix-bearing cylinders of identical diameters.

A further problem is the adjustment of the doctor with respect to the surface of the matrix-bearing cylinder.

A further problem in known machines is continuously measuring and controlling the pressure of the doctor against the external surface of the cylinder during the work cycle.

A further problem, connected to the above-cited drawbacks, is the dismounting and subsequent remounting of the doctor, simply and rapidly and without having each time to perform laborious adjustment and set-up operations.

The main aim of the present invention is to obviate the limitations and drawbacks of the prior art and to provide a simple and effective solution to them.

An advantage of the invention is that it presents a structure allowing easy remote control, without having to perform operations in proximity of the machine.

These aims and advantages and others besides are all achieved by the present invention, as it is characterized in the appended claims.

SUMMARY OF THE INVENTION

On a mobile rest plane on which tiles are translated in a predetermined direction, the following operate: a matrix-bearing cylinder, mobile in rotation about an axis thereof, and at least a doctor predisposed to operate contactingly with an external surface of the cylinder. The apparatus comprises: a vertically-developing frame; a first slide constrained on the vertical frame and slidable vertically with respect thereto; the matrix-bearing cylinder being supported on the first slide, together with organs for supporting the matrix-bearing cylinder and organs for controlling rotation thereof about a rotation axis thereof; a second slide, with at least one doctor being supported thereon, together with organs for supporting the doctor and organs for controlling movements thereof, is constrained on the frame and can slide vertically with respect thereto. An electrically-activated maneuvering screw produces relative positioning of the first slide and the second slide and positioning of the slides with respect to the vertically-developing frame.

BRIEF DESCRIPTION OF THE DRAWINGS

Further characteristics and advantages of the present invention will better emerge from the detailed description that follows, of a preferred but non-limiting example of the invention, in a preferred but non-exclusive embodiment thereof, illustrated by way of example in the accompanying figures of the drawings, in which.

DESCRIPTION OF THE PREFERRED EMBODIMENTS

Figure 1:
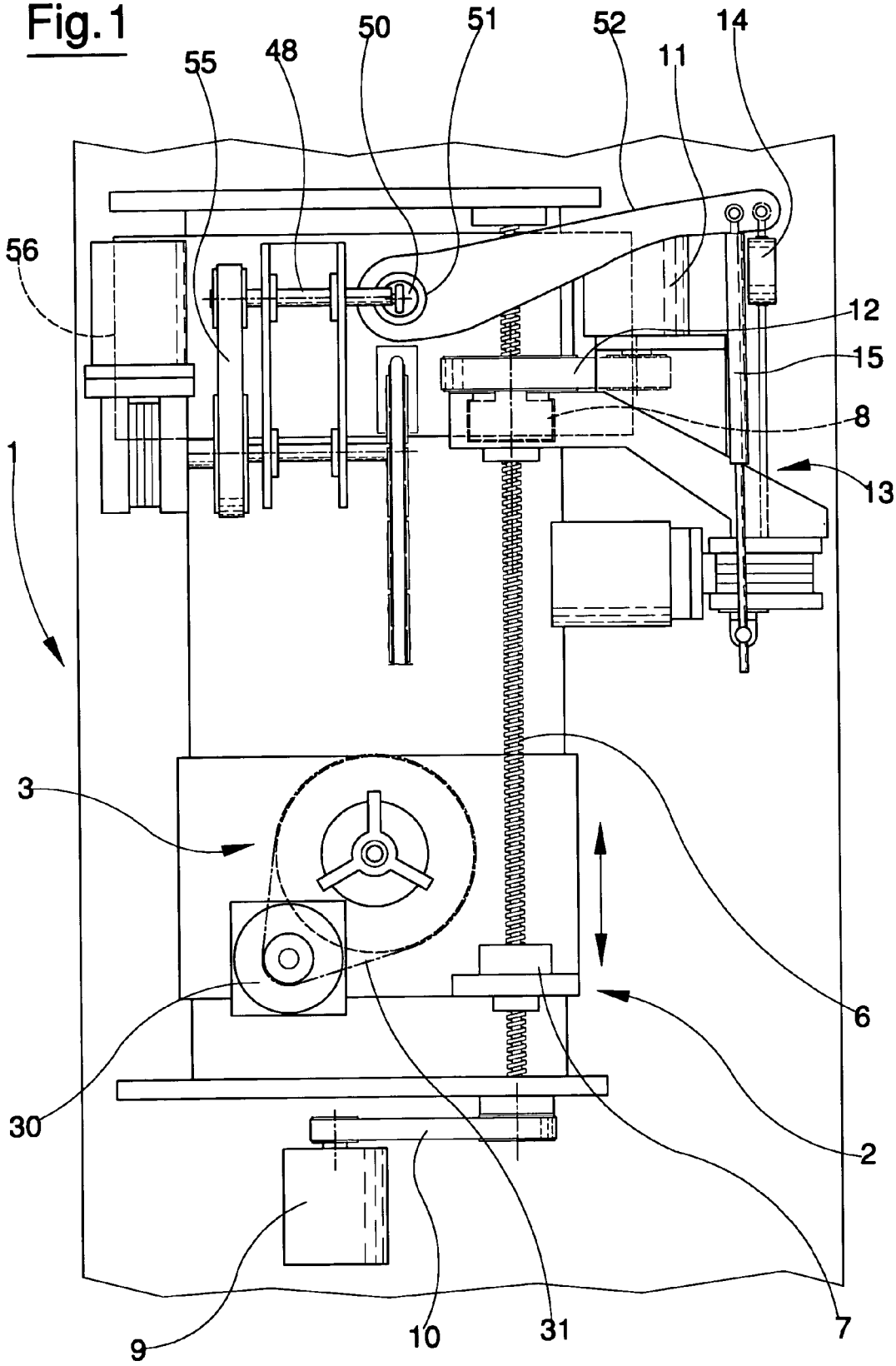
FIG. 1 is a schematic front view in vertical elevation.
Figure 2:
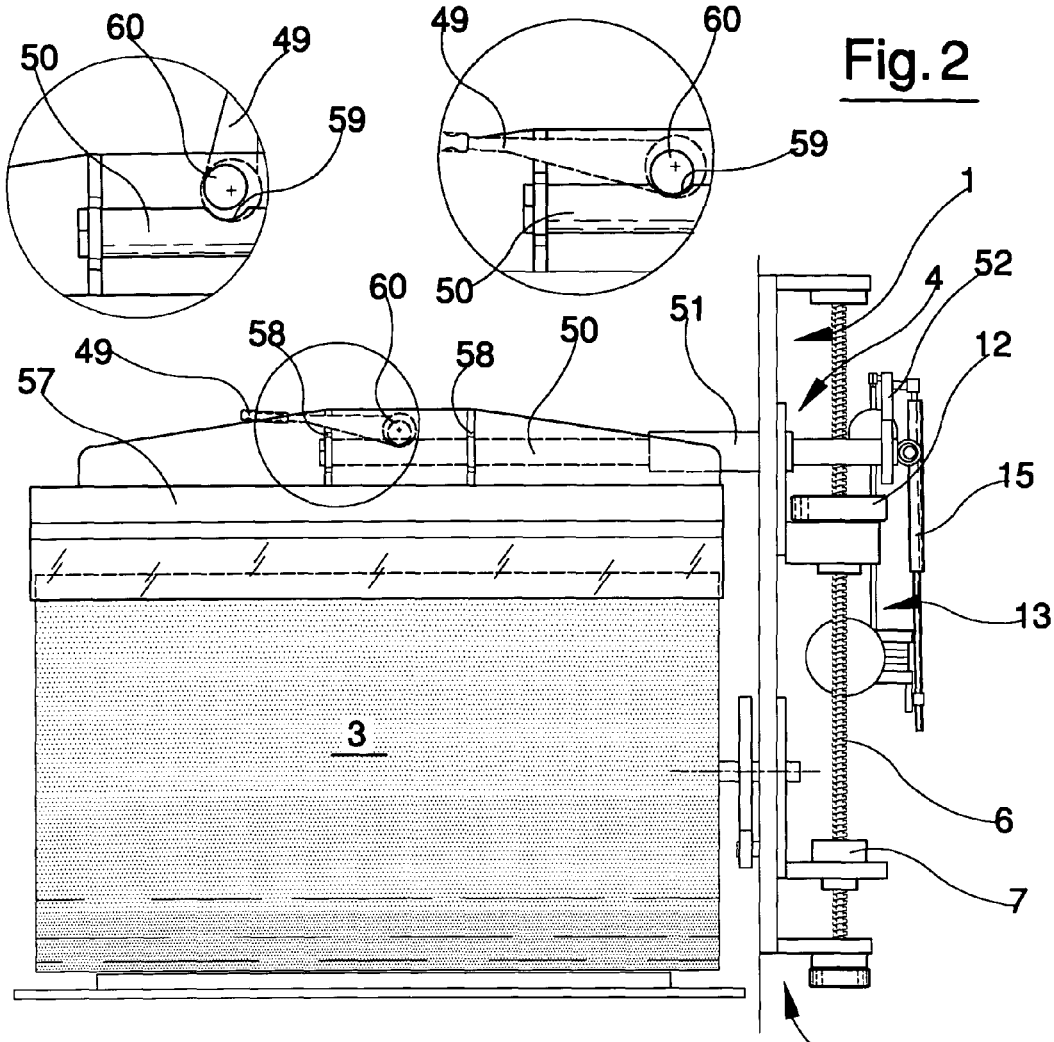
FIG. 2 is a schematic lateral view from the left of FIG. 1.
Figure 3:
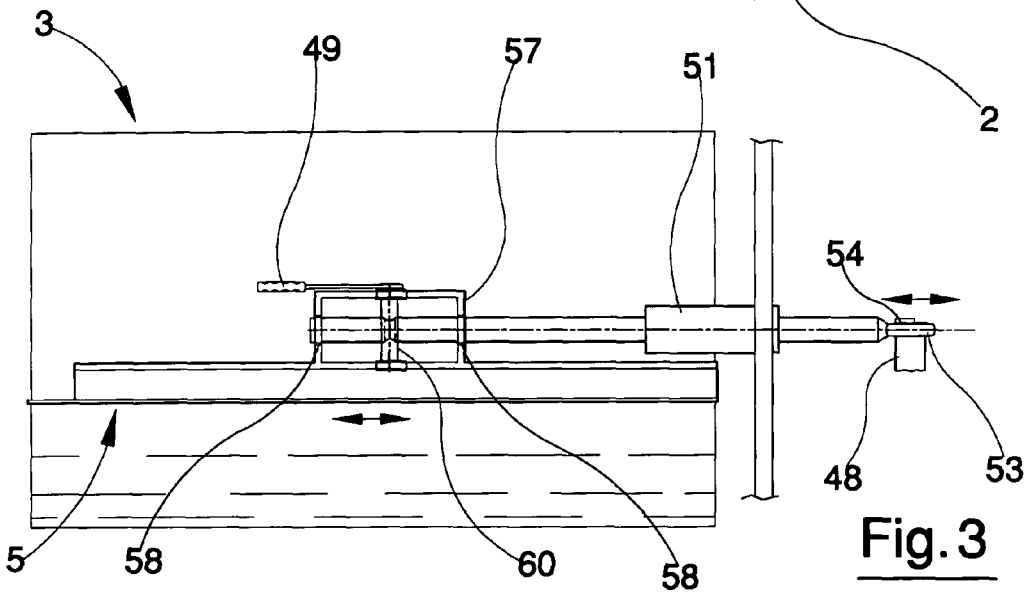
FIG. 3 is a schematic view from above of FIG. 2.
Figure 4:
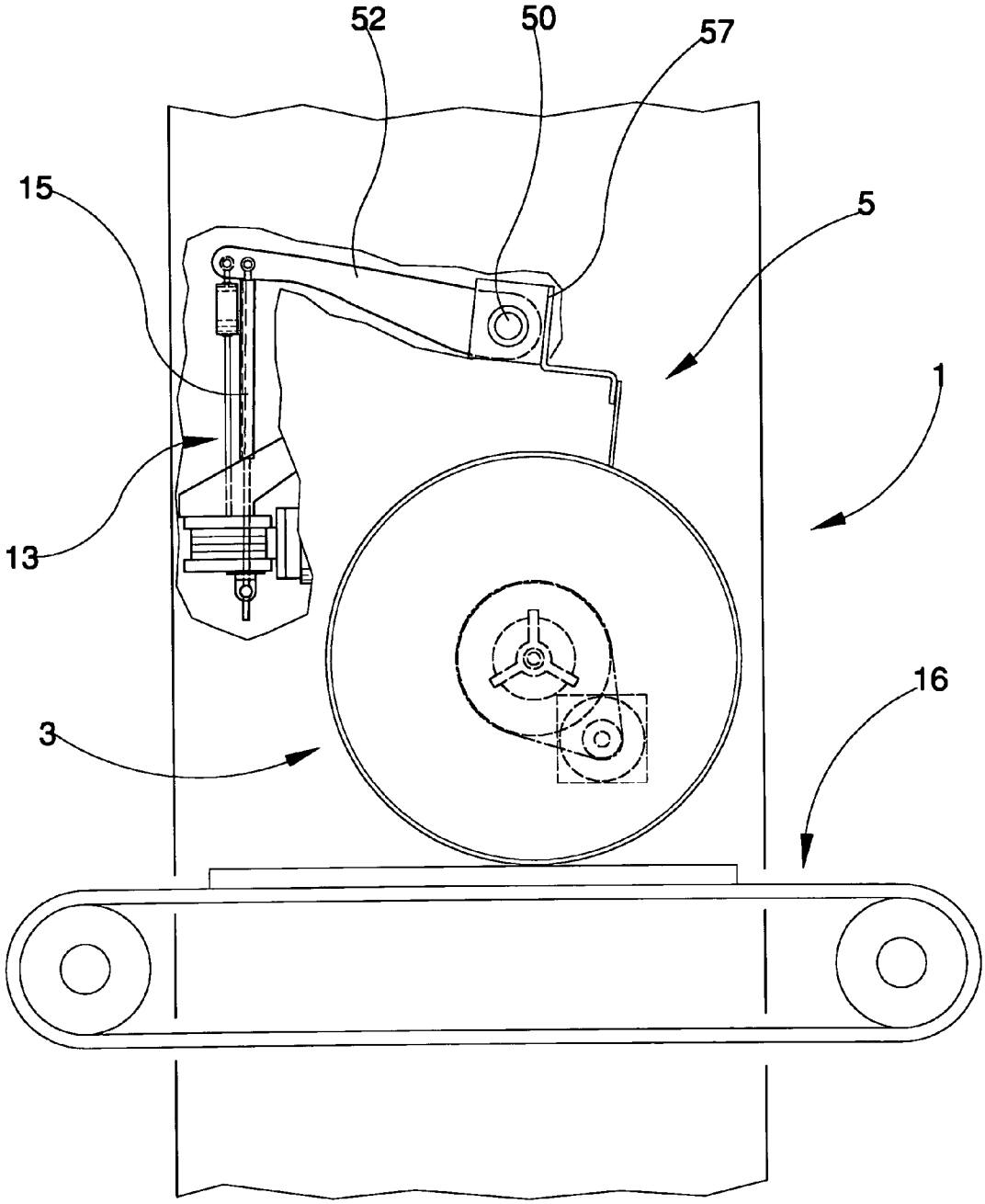
FIG. 4 is a schematic lateral view from the left of FIG. 2.

With reference to the figures of the drawings, 1 denotes in its entirety a vertical frame of a rotary machine for decoration of ceramic tiles, of a type in which tiles are translated in a predetermined direction on a mobile rest plane 16, on which a matrix-bearing cylinder 3 operates, which cylinder 3 is rotatingly mobile about an axis thereof, with at least one doctor being predisposed to operate contactingly on the external surface of the matrix-bearing cylinder 3. The cylinder 3 is provided with at least one elastically-deformable peripheral part delimited by a smooth external cylindrical surface, made of an elastomer material and on which a shape has been cut, or recessed; this is the matrix.

A first slide 2 is constrained on the frame 1 and slides in a vertical direction; the matrix-bearing cylinder 3 is supported on the first slide 2 together with the organs supporting the cylinder 3 and rotating it about an axis thereof. In particular, rotation drive is transmitted to the cylinder 3 by a brushless motor, not included in the figures of the drawings.

A step motor 30 driven by a cogged belt transmission 31 centers the cylinder 3 on the transit axis of the tiles moving on the mobile rest plane 16.

A second slide 4 is constrained to the frame 1 above the first slide 2, and slides vertically thereto. The second slide 4 supports at least one doctor 5 together with the organs supporting and moving the doctor 5.

The relative positioning with respect to the vertical frame 1 and therefore with respect to the mobile rest plane 16, of the first slide 2 and the cylinder 3 and the second slide 4, and consequently also the doctor 5, is done by simple electronically-controlled electromechanical means.

The electronically-controlled electromechanical means comprise: a vertical-axis maneuvering screw 6 on which a first nut 7 is coupled, which first nut 7 is solidly constrained to the first slide 2, and a second nut 8 which is coupled solidly in translation along the rotation axis to the second slide 4, and. rotatable with respect thereto about the common axis.

The maneuvering screw 6 is rotated by predetermined amounts about the axis thereof by a first step motor 9. Transmission of drive is effected by a belt transmission 10.

The second nut 8 is made to rotate by predetermined amounts about an axis thereof and thus with respect to the second slide 4, by a second step motor 11 which is solidly constrained to the second slide 4 by a belt transmission 12. This configuration allows displacements of predetermined entities (position adjustment) in a vertical direction, i.e. parallel to the axis of the maneuvering screw 6, of the whole second slide 4, and thus of the doctor 5 supported thereon, independently of the activating of the maneuvering screw itself. It is thus possible to make a fine adjustment of the distance between the doctor 5 and the matrix-bearing cylinder 3. This also enables a variation in the inclination of the doctor 5 with respect to the external cylindrical surface of the matrix-bearing cylinder 3.

The doctor 5 is mounted removably on the shaft 50 which is connected to the second slide 4 and is positioned parallel to the rotation axis of the cylinder 3. In particular, the shaft 50 is coaxially supported in a sleeve 51 which is solidly constrained to the second slide 4, to which are connected means for controlling the adjustment of the inclination of the doctor 5 and for controlling the pressure of the doctor 5 against the external surface of the matrix-bearing cylinder 3.

The means for controlling comprise a linear actuator 13 which operates in both directions between the body of the second slide 4 and the second end of a lever 52, a first end of which is solidly constrained in rotation with the shaft 50, and a measuring device 15, also operating between the body of the second slide 4 and the second end of the lever 52 for measuring displacements with respect to a prefixed reference, and, consequently, to measure inclinations with respect to the vertical.

The linear actuator 13 is constituted by a screw-jack actuated by a gear reducer controlled by a step motor; the jack operates in connection with a force-measuring device 14 which measures the total force exerted by the jack on the lever 52. Obviously the measure of the force read directly and instantaneously indicates the value of the pressure with which the doctor 5 presses on the external cylindrical surface of the matrix-bearing cylinder 3. Knowing instantaneously the pressure effectively exerted by the doctor 5 on the external cylindrical surface of the matrix-bearing cylinder 3 allows a fine adjustment of the pressure moment by moment and completely automatically, apart from, obviously, enabling a perfect setting-up of the system in line with the sought-for result.

The presence of the measuring device 15 means that the inclination can also be measured moment by moment, with the consequent possibility of acting, for example by adjusting the distance between the second slide 4 and the first slide 2.

Different embodiments of the linear actuator 13 are possible, and of the measuring device connected there-to, for carrying out the function as described. In particular purely electrical or electrical-hydraulic actuators can be used, where, for example, the measurement of the force applied is obtained by direct measurement of the pressure of a fluid.

With the above-described apparatus the adjustment of the positions with respect to the mobile rest plane 16 of the cylinder 3 and the doctor 5 can be performed, as well as the adjustment of the relative position of the inclination and the pressure with which the doctor 5 acts contactingly with the matrix-bearing cylinder 3.

Automated control of all adjustment operations is very simply and directly achieved. In particular, for example, any adjustment can be stored to be re-used and recalled when necessary (for example, when changing single set-ups or changing the diameter of the matrix-bearing roller).

A device for controlledly imparting oscillating motion to the doctor 5 is supported on the second slide 4.

The oscillating motion is actually imparted on the shaft 5 supporting the doctor 5.

The shaft 50 is supported by a free coupling in the sleeve 51 and is coupled to the lever 52 solidly in rotation, but slidable axially. The shaft 50 also exhibits an end affording a slot 53 internally of which a cam pivot 54 engages, which pivot 54 is solidly constrained to a shaft 48. The shaft 48 rotates, on command, about an axis which is perpendicular to the axis of the shaft 50, by a step motor 56 via a belt transmission 55. The movement of the cam pivot 54 in the slot 53 produces, as a result, an alternating oscillating motion of the shaft 50 with respect to the sleeve 51 and the lever 52. This motion is solidly transmitted to the doctor 5.

The doctor is fixed to a support frame 57 provided with coaxial housings 58 internally of which the shaft 50 can be snugly coupled. The shaft 50 is also provided with a transversal hollow seating 59, which receives, in a stable coupling, a pivot 60 mounted eccentrically on the support frame 57, which pivot 60 is activated by a lever 49 so that it can pass from the stable coupled position with the hollow seating 59 to a completely uncoupled position in which the shaft 50 is free internally of the coaxial housings 58.

In particular, the hollow seating 59 is constituted by a portion of surface of straight circular cylinder. The pivot 60 exhibits an external diameter which is the same as the diameter of the portion of surface of the straight circular cylinder delimiting the hollow seating 59.

The above-described arrangement enables an extremely rapid coupling and uncoupling of the doctor 5 on and from the shaft 50 and on and from the machine.

The above coupling and uncoupling operations of the doctor 5 do not require any special operations or the need to perform adjustments to correctly position the doctor 5, because the coupling of the pivot 60 in the hollow seating 59 ensures an automatic and perfect centering of the doctor 5 on the shaft 50 and therefore a perfect positioning of the doctor 5 with one simple maneuver only.

What is claimed is:

1. An apparatus for regulating components of rotary machines for decoration of ceramic tiles, comprising:

a rotary machine that translates tiles in a first direction on a mobile rest plane;

a matrix-bearing cylinder having an axis of rotation, the cylinder mobile in rotation about the axis, which matrix-bearing cylinder is provided with at least an elastically-deformable peripheral part having a smooth external cylindrical surface made of an elastomer material, on which smooth external cylindrical surface a shape is cut and recessed, which shape is a matrix;

at least a doctor predisposed for operating in contact with the external surface of the matrix-bearing cylinder;

a vertically-developing frame;

a first slide constrained on the vertically-developing frame and slidable vertically with respect thereto;

the matrix-bearing cylinder being supported on the first slide, together with organs for supporting the matrix-bearing cylinder and organs for controlling rotation thereof about a rotation axis thereof;

a second slide constrained on the vertically-developing frame and sliding vertically with respect thereto;

the at least one doctor being supported on the second slide, together with organs for supporting the at least one doctor and organs for controlling movements of the at least one doctor;

means for relatively positioning the first slide and the second slide relative to the vertically developing frame.

2. The apparatus of claim 1, wherein the means for relatively positioning comprise: a maneuvering screw having a vertical axis, on which maneuvering screw are coupled a first nut, which is solidly constrained to the first slide, and a second nut, which is solidly constrained in translation along the vertical axis to the second slide and which is mobile in rotation about the vertical axis with respect to the second slide (4), which vertical axis is also a rotation axis of the second nut and the first nut.

3. The apparatus of claim 2, wherein the maneuvering screw is commanded to perform rotations of entities about the vertical axis of rotation thereof by a first step motor; the second nut being commanded to perform rotations of entities about the vertical axis of rotation and with respect to the second slide by a second step motor which is solidly constrained to the second slide.

4. The apparatus of claim 2, wherein the second slide is connected to a shaft for supporting the doctor, which shaft is positioned parallel to the axis of rotation of the matrix-bearing cylinder and which shaft is coaxially supported in a sleeve.

5. The apparatus of claim 4, wherein the second slide is associated to means for controlling a regulation of an inclination of the at least one doctor and also for controlling a pressure with which the at least one doctor is pressed contactingly against an external surface of the matrix-bearing cylinder; the means comprising a linear actuator operating in two directions between the second slide and a second end of a lever, a first end of which is solidly constrained in rotation to the shaft and a measuring device, which measuring device also operates between the second slide and the second end of the lever in order to measure displacements of the second slide with respect to a reference position.

6. The apparatus of claim 5, wherein the linear actuator operates together with a force measuring device, which measures an overall force which is exerted by the, linear actuator on the lever.

7. The apparatus of claim 4, wherein the shaft is supported by a free coupling in the sleeve and is rotatably and axially slidably coupled to the lever; the shaft exhibiting an end affording a slot internally of which a cam pivot is engaged, which cam pivot is solidly constrained to a spindle shaft; the spindle shaft being commanded to rotate about a perpendicular axis to the axis of the shaft by a step motor and belt transmission.

8. The apparatus of claim 7, wherein the doctor is fixed to a support frame affording coaxial housings internally of which support frame the shaft is snugly coupled, which shaft affords a transversal hollow seating; the transversal hollow seating stably coupling with a pivot mounted eccentrically on the support frame and activated by a lever in order to pass from the stable coupling position with the hollow seating to a completely uncoupled position in which the shaft is free inside the coaxial housings.

9. The apparatus of claim 8, wherein the hollow seating is constituted by a portion of straight, circular cylindrical surface and in that the pivot exhibits an external diameter which is equal to a diameter of the portion of straight, circular cylindrical surface delimiting the hollow seating.

10. The apparatus of claim 3, wherein the second slide is connected to a shaft for supporting the doctor, which shaft is positioned parallel to the axis of rotation of the matrix-bearing cylinder and which shaft is coaxially supported in a sleeve.

11. An apparatus for regulating components of rotary machines for decoration of ceramic tiles, comprising:

a rotary machine that translates tiles in a first direction on a mobile rest plane (16);

a vertically-oriented frame (1) of the rotary machine;

a matrix-bearing cylinder (3) positioned over the rest plane to contact an upper surface of the tiles in translating the tiles in the first direction, the cylinder having a horizontal rotational axis and vertically displaceable with respect to the frame and the mobile rest plane;

at least one elastically-deformable peripheral matrix part provided on the cylinder, the matrix part delimited by a smooth external cylindrical surface made of an elastomer material having a recessed matrix surface shape;

at least one doctor (5) positioned to operate contactingly on an external surface of the matrix-bearing cylinder;

a single maneuvering screw connected to the frame and having a vertical axis;

a first slide (2) constrained on the frame and slideable in the vertical direction via the maneuvering screw;

parts supporting the matrix-bearing cylinder on the first slide so that the cylinder is movable in the vertical direction;

a second slide (4) constrained to the frame above the first slide and supporting the at least one doctor, the second slide slidably in the vertical direction via the maneuvering screw;

parts controlling movement of the at least one doctor; and the maneuvering screw connected to the first slide and connected to the second slide and controlling relative positioning of the first slide and the second slide relative to the frame, adjustment of the doctor with respect to the matrix-bearing cylinder, and height adjustment of the matrix-bearing cylinder with respect to the mobile rest plane.

12. The apparatus of claim 11, wherein, a first nut (7) is coupled to the maneuvering screw and solidly constrained to the first slide, a second nut (8) is coupled to the maneuvering screw and is free to rotate with respect to the second slide and is solidly constrained in translation along the vertical axis to the second slide and mobile in rotation about the vertical axis with respect to the second slide (4), the vertical axis is also a rotation axis of the first nut and the second nut, the first nut and the second nut independently controllably displaceable along the same vertical direction and controlling displacements of the first and second slides along the vertical direction.

13. The apparatus of claim 12, wherein, a first step motor rotates the maneuvering screw to command the first nut to translate up and down in the vertical direction directly by the rotation of the maneuvering screw resulting from operation of the first step motor, and a second step motor acts on the second nut to control displacement of the second slide.

14. The apparatus of claim 11, wherein, a first nut (7) coupled to the maneuvering screw, the first nut is solidly constrained to the first slide, a second nut is coupled to the maneuvering screw, the second nut coupled solidly in translation, along the vertical axis of the maneuvering screw, to the second slide.

15. The apparatus of claim 14, wherein, a first motor (9) rotates the maneuvering screw, and a second motor (11) rotates the second nut.

16. The apparatus of claim 15, wherein, a belt transmission (10) connects the first motor to the maneuvering screw, and the second motor is solidly constrained to the second slide by another belt transmission (12), operation of the first and second motors independently positions the first and second slides vertically along the maneuvering screw.

17. The apparatus of claim 15, wherein, the doctor is inclinable with respect to an external cylindrical surface of the matrix-bearing cylinder.

* * * * *